US009609967B2

(12) United States Patent
Stewart-Stand

(10) Patent No.: US 9,609,967 B2
(45) Date of Patent: Apr. 4, 2017

(54) MULTIPURPOSE EATING UTENSIL

(71) Applicant: Theo Stewart-Stand, Brooklyn, NY (US)

(72) Inventor: Theo Stewart-Stand, Brooklyn, NY (US)

(73) Assignee: FOLDITFLAT, Brooklyn, NY (US)

( * ) Notice: Subject to any disclaimer, the term of this patent is extended or adjusted under 35 U.S.C. 154(b) by 0 days.

(21) Appl. No.: 14/693,036

(22) Filed: Apr. 22, 2015

(65) Prior Publication Data

US 2016/0309934 A1 Oct. 27, 2016

(51) Int. Cl.
*A47G 21/02* (2006.01)
*A47G 21/00* (2006.01)

(52) U.S. Cl.
CPC ..... *A47G 21/02* (2013.01); *A47G 2021/002* (2013.01)

(58) Field of Classification Search
CPC .. A47G 21/02; A47G 21/26; A47G 2021/002; B65D 5/2047; B65D 5/22; B65D 5/20; B65D 5/2038
USPC ..... 30/147–150, 142
See application file for complete search history.

(56) References Cited

U.S. PATENT DOCUMENTS

| | | | | | |
|---|---|---|---|---|---|
| 1,521,768 | A * | 1/1925 | Herrmann | A47G 21/04 | 30/328 |
| 2,598,987 | A * | 6/1952 | Franzen | B65D 51/246 | 215/228 |
| 3,121,951 | A * | 2/1964 | Green | A47G 21/02 | 30/149 |
| 3,828,999 | A * | 8/1974 | Humphrey | A47G 21/04 | 229/401 |
| 3,931,925 | A * | 1/1976 | Ruff | A47G 21/04 | 229/125.03 |
| 9,131,793 | B2 * | 9/2015 | Cross | A47G 21/04 | |
| 9,265,372 | B2 * | 2/2016 | Stewart-Stand | A47G 21/02 | |
| 2014/0190022 | A1 * | 7/2014 | Siren | A47J 43/281 | 30/324 |
| 2015/0257560 | A1 * | 9/2015 | Boateng, II | A47G 21/02 | 30/136 |

* cited by examiner

*Primary Examiner* — Phong Nguyen
(74) *Attorney, Agent, or Firm* — Andrew Wilford

(57) ABSTRACT

A multipurpose eating utensil has two side parts of flexible sheet material having inner edges joined unitarily by a membrane hinge unitarily for movement of the side parts between a flattened position extending generally coplanar with each other and a folded use position extending at an acute angle to each other from the hinge with the outer edges closely juxtaposed. Front and rear utensil parts are formed unitarily with the side parts of the thin but flexible sheet material and each have an inner edge joined unitarily to ends of both of the side parts and an outer end edge. One of the outer end edges is formed as a fork and the other as a spoon. Male and female fastening formations formed unitarily with the outer side edges can be fitted together to retain the side parts in the folded use position.

8 Claims, 2 Drawing Sheets

MULTIPURPOSE EATING UTENSIL

CROSS REFERENCE TO RELATED APPLICATION

This application is a replacement of U.S. provisional application 62/071,170 filed 16 Sep. 2014 and is a continuation-in-part of U.S. nonprovisional application Ser. No. 14/220,154 filed 20 Mar. 2014 as a continuation-in-part of copending application Ser. No. 14/140,586 filed 26 Dec. 2013.

FIELD OF THE INVENTION

The present invention relates to a multipurpose eating utensil. More particularly this invention concerns such a utensil that can be used as at least as a spoon or fork, but also as a knife, and that can be carried or stored flat.

BACKGROUND OF THE INVENTION

It is known to make a so-called spork of a single piece of plastic, with one end formed as a standard flat eating-utensil handle, and the other end formed with a slightly cup-shaped bowl for use as a spoon and an outer edge provided with teeth for use as a fork. Such a utensil is typically provided to small children who are not capable of switching between utensils, and who might harm themselves with standard forks, not to mention the harm that could be done even with a plastic knife.

It is also known to provide a pen knife with spoon, fork, and of course knife attachments so that it can be used, for instance, by a camper who need not carry a selection of utensils for eating when away from civilization.

None of these applications is fully satisfactory. The child's spork is useless when food has to be cut or, for instance, it is necessary to spread something like butter. The camper's device requires manipulation for switching from one use to the other. Both systems do not store flat, that is they cannot be reduced to a shape that is efficient for storage and transport.

OBJECTS OF THE INVENTION

It is therefore an object of the present invention to provide an improved multipurpose eating utensil.

Another object is the provision of such an improved multipurpose eating utensil that overcomes the above-given disadvantages, in particular that can be used as both a spoon and a fork and, if desired, a knife also.

A further object is to provide such a utensil that can be used without manipulation for any of its two or three applications.

Another object is to provide such a utensil that can be stored perfectly flat, that is lying in a plane so that it takes up very little space and can be stacked.

A further object is to make such a utensil that can be incorporated in a food package, and that can be produced at very low cost so that it can be disposed of after a single use.

SUMMARY OF THE INVENTION

A multipurpose eating utensil has according to the invention a pair of geometrically similar side parts of thin but flexible sheet material having confronting, longitudinally extending, and adjacent inner edges and longitudinally extending outer edges turned transversely away from each other. A membrane hinge unitarily interconnects the inner edges for movement of the side parts between a flattened position extending generally coplanar with each other and a folded use position extending at an acute angle to each other from the hinge with the outer edges closely juxtaposed. Front and rear utensil parts are formed unitarily with the side parts of the thin but flexible sheet material and each have an inner edge joined unitarily to ends of both of the side parts and an outer end edge. One of the outer end edges is formed with a plurality of longitudinally projecting fork tines, one of the longitudinally extending side edges is formed as a cutting tool, and the other of the outer end edge is formed as a spoon bowl. A female fastening formation is formed unitarily with one of the side parts at the outer edge thereof and forms a transversely and outwardly open notch at the respective outer edge. A male fastening formation is formed unitarily with the other of the side parts at the outer edge thereof and is fittable in the notch in the folded use position to retain the side parts in the folded use position.

The provision of unitary fastening formations allows the utensil of this invention to be produced at very low cost in a single step by a simple stamping or molding operation. In the flattened position the entire utensil has a maximum thickness equal to a single thickness of the material it is made from, so a very large quantity of the utensils can be stacked in a small space for storage, transport, or dispensing. What is more, the flattened utensil can be incorporated into or secured to a food package without perceptible increasing its bulk or weight, so that foods such as yogurt, ramen, or soup can be sold with the utensil needed to consume them.

According to the invention the notch is formed by a pair of short and longitudinally spaced cuts extending transversely inward from the one outer edge and a deflectable tab formed therebetween. For securing the side parts together in the folded position, the male fastening part is passed through and spread outward of the notch.

According to another feature of the invention, the notch is formed by a cutout that opens outwardly at the one outer edge. No deflectable tab is provided.

In accordance with the invention, the male fastening formation is formed by a pair of longitudinally oppositely projecting wings deflectable to pass through the notch and engaging outside the other side in the folded use position.

According to the invention at least one transverse fold line extends between the spoon part and rear ends of the side parts. This line can extend through both of the side parts between the outer edges thereof, or be longitudinally offset from the male and female fastening formations.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
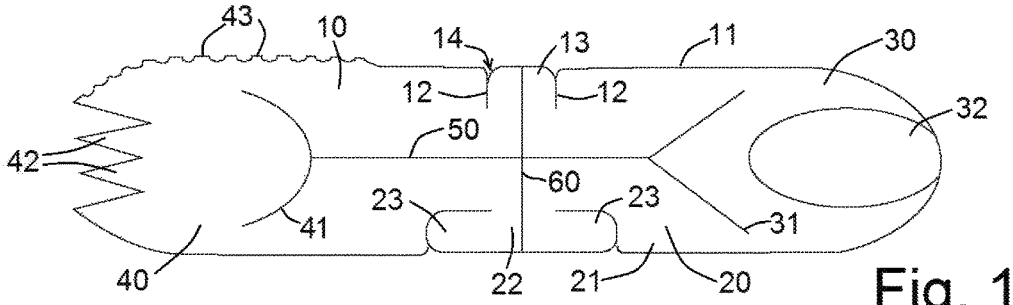
FIG. 1 is a plan view of an eating utensil according to the invention.
Figure 2:
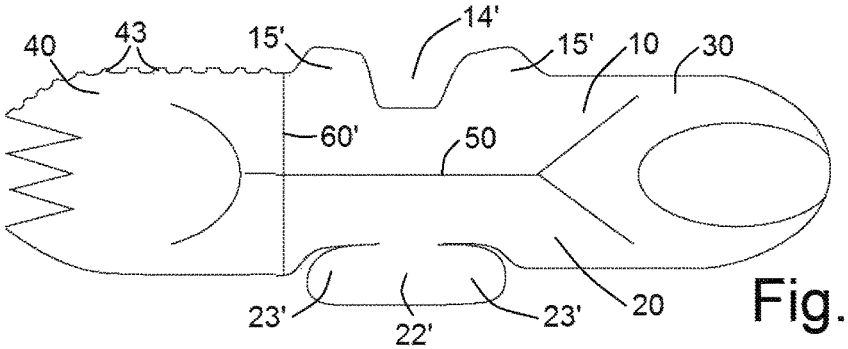
FIG. 2 is a view like FIG. 1 of a variation on the utensil.

As seen in FIGS. 1 and 2, a utensil 100 according to the invention shown here in flattened condition is formed basically of two side parts 10 and 20 and end parts 30 and 40 all stamped out of a flexible but stiff plastic sheet, e.g. of polypropylene 0.030 to 0.036 in thick.

The two side parts 10 and 20 are of similar shape and have longitudinally extending inner edges joined together at a straight membrane hinge 50 defining a longitudinally extending and centered fold line. A V-shaped rear fold line 31 centered on the hinge 50 opens toward and defines the rear end part 30 shaped at 32 to form a spoon. A C-shaped front fold line 41 also centered on the hinge 50 opens toward the front and defines the front end part 40 formed at a front end with short fork tines 42 and along one side edge with cutting teeth 43, so that the front end 40 can work as a fork or a knife.

The side parts 10 and 20 have parallel, straight, and longitudinally extending outer edges 11 and 21. The edge 11 is formed with two longitudinally spaced and transversely extending short cuts 12 flanking a tab 13 deflectable to form an outwardly open female fastening formation or notch 14. The edge 21 has a stamped-out T-shaped male fastening formation 22 forming a pair of wings 23.

Figure 3:
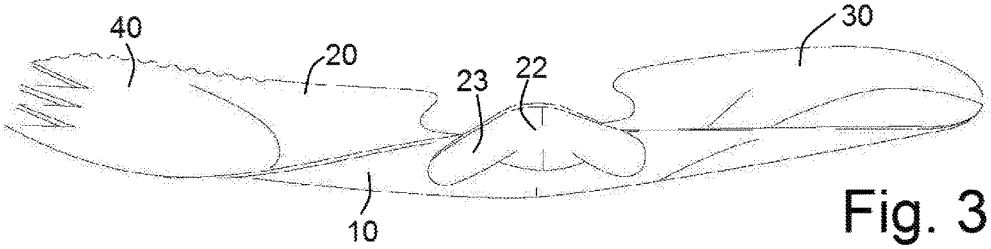
FIG. 3 shows the eating utensil in a perspective view from above and to the side in use position.
Figure 4:
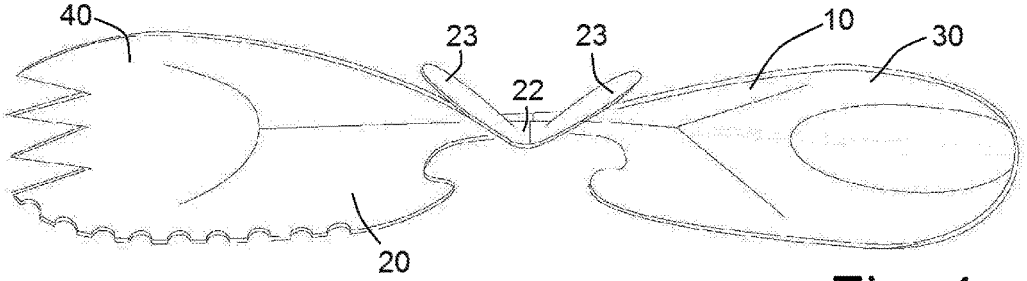
FIG. 4 is a perspective view of the utensil as in FIG. 3.

As shown in FIGS. 1 and 2, During transport or storage or when held in a stack in a dispenser, all parts of the utensil are coplanar so that the utensil has an overall thickness equal to a single layer of the sheet material from which it is stamped. For use as shown in FIGS. 3 and 4, the end user pushes the two outer edges 11 and 21 toward each other to fold the utensil along the hinge 50 until the wings 23 of the male fastening formation 22 can be tucked through the notch 14. This interfit of the male and female fastening formations 22 and 14 retains the structure in the folded position of FIGS. 3 and 4 so that it can be used as a spoon, fork, or knife. In this position the utensil will retain its shape even when not being held.

FIG. 2 shows a variation on the utensil of FIG. 1. Here the edge 11 is formed with a pair of outwardly projecting tabs 15' flanking an outwardly flaring trapezoidal notch 15' constituting the female fastening formation. The mail formation is formed by a tab 22' also projecting past the respective outer edge 21 and having wings 23'. This tab 22' can be tucked through the notch 14' with the wings 23' catching on the back faces of the tabs 15' for use as shown in FIGS. 3 and 4.

Figure 5:
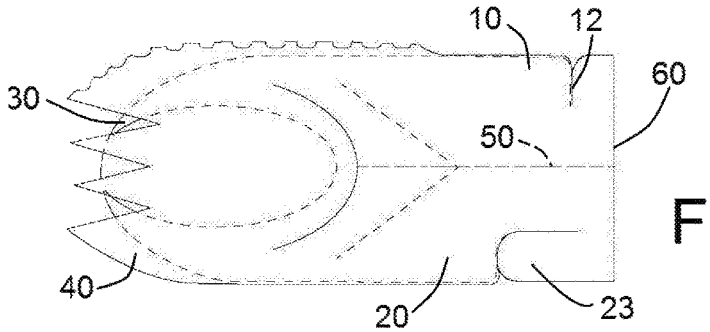
FIG. 5 shows the eating utensil in folded condition.

In FIG. 1 the utensil is shown to have a transversely throughgoing central fold line 60 that allows it to be folded in half as shown in FIG. 5 with the flat ends 30 and 40 lying atop each other. This clearly illustrates how small the utensil of this invention can be. FIG. 2 shows that the transverse fold line 60' is moved toward the front fork part 40. it could similarly be moved from a central position in the opposite direction toward the rear spoon part 30, away from the fastening formations 14' and 22'.

Figure 6:
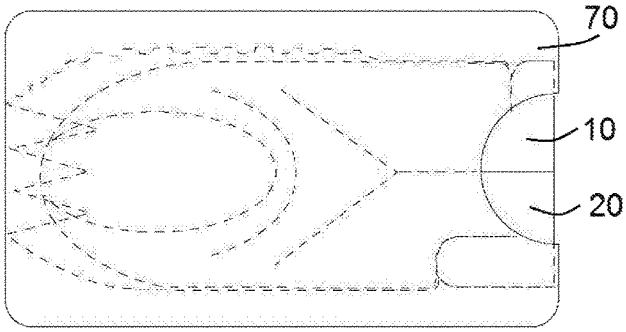
FIG. 6 shows the eating utensil in folded condition contained in an envelope.

FIG. 6 shows how the utensil, when folded in half, can be held in a simple envelope 70 for hygienic storage and transport.

Figure 7:
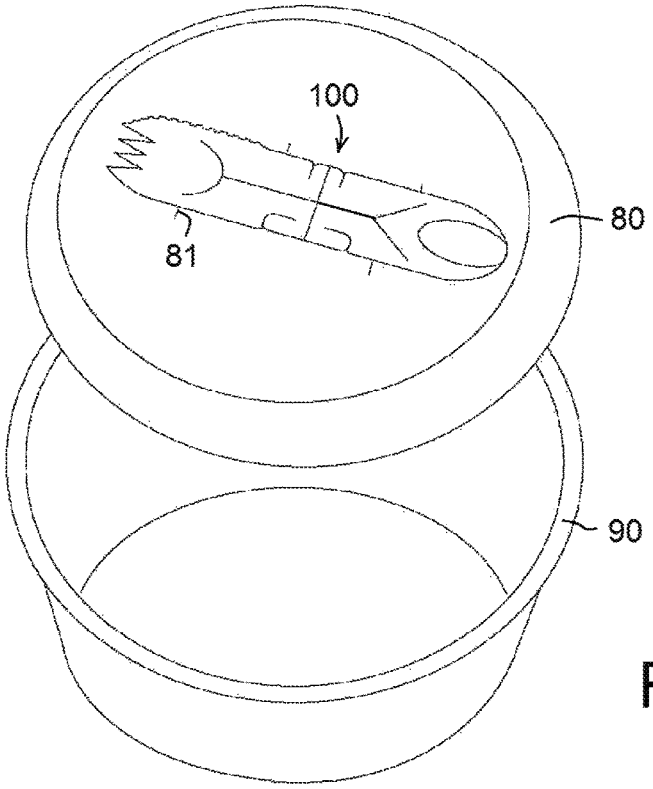
FIG. 7 shows the eating utensil combined with a food package.

FIG. 7 shows how the utensil can be held by integral clips 81 to a lid 80 of a food container 90 for a food like yogurt, ramen, or soup that is either ready to eat or intended for eating after microwaving in the package it is sold in.

I claim:

1. A multipurpose eating utensil comprising:

a pair of geometrically similar side parts of thin but flexible sheet material having confronting, longitudinally extending, and adjacent inner edges and longitudinally extending outer edges spaced transversely apart from each other;

a membrane hinge unitarily interconnecting the inner edges for movement of the side parts between a flattened position extending generally coplanar with each other and a folded use position extending at an acute angle to each other from the hinge with the outer edges closely juxtaposed;

a front utensil part formed unitarily with the side parts of the thin but flexible sheet material and having an inner end joined unitarily to ends of both of the side parts, an outer end formed with a plurality of longitudinally projecting fork tines, and a longitudinally extending side formed as a cutting tool;

a rear utensil part formed unitarily with the side parts of the thin but flexible sheet material, whereby in the folded use position the rear utensil part forms a spoon bowl;

a female fastening formation formed unitarily with one of the side parts at the outer edge thereof and forming a transversely and outwardly open notch at the respective outer edge; and a male fastening formation formed unitarily with the other of the side parts at the outer edge thereof and fittable in the notch in the folded use position to retain the side parts in the folded use position.

2. The eating utensil defined in claim 1, wherein the notch is formed by a pair of short and longitudinally spaced cuts extending transversely inward from the one outer edge and a deflectable tab formed therebetween.

3. The eating utensil defined in claim 1, wherein the notch is formed by a cutout that opens outwardly at the one outer edge.

4. The eating utensil defined in claim 1, wherein the male fastening formation is formed by a pair of longitudinally oppositely projecting wings deflectable to pass through the notch and engaging outside the other side in the folded use position.

5. The eating utensil defined in claim 1, wherein the sheet material is plastic.

6. The eating utensil defined in claim 1, further comprising a transversely throughgoing fold line extending through both of the side parts between the outer edges thereof.

7. The eating utensil defined in claim 6, wherein the transverse fold line extends through the male and female fastening formations.

8. The eating utensil defined in claim 6, wherein the transverse fold line is longitudinally offset from the male and female fastening formations.

* * * * *